US005146280A

United States Patent [19]

Kisu

[11] Patent Number: 5,146,280

[45] Date of Patent: Sep. 8, 1992

[54] CHARGING DEVICE

[75] Inventor: Hiroki Kisu, Ichikawa, Japan

[73] Assignee: Canon Kabushiki Kaisha, Tokyo, Japan

[21] Appl. No.: 656,968

[22] Filed: Feb. 19, 1991

[30] Foreign Application Priority Data

Feb. 17, 1990 [JP] Japan ..... 2-37060

[51] Int. Cl.[5] ..... G03G 15/02

[52] U.S. Cl. ..... 355/219; 361/225

[58] Field of Search ..... 355/219, 221, 222, 225, 355/226; 361/225, 230; 250/324, 325

[56] References Cited

U.S. PATENT DOCUMENTS

| | | | |
|---|---|---|---|
| T. 886,015 | 11/1970 | Stahr et al. | 250/49.5 |
| 2,934,650 | 4/1960 | De Witt | 250/325 |
| 2,980,834 | 4/1961 | Tregay et al. . | |
| 3,626,260 | 12/1971 | Kimura et al. . | |
| 3,675,096 | 7/1972 | Kiess | 250/325 |
| 3,778,690 | 12/1973 | Rothacker et al. | 250/325 X |
| 3,935,517 | 1/1976 | O'Brien | 250/325 X |
| 3,936,174 | 2/1976 | Carpenter . | |
| 4,028,551 | 6/1977 | Thompson | 250/324 X |
| 4,387,980 | 6/1983 | Ueno et al. . | |
| 4,466,729 | 8/1984 | Iwata et al. | 250/326 X |
| 4,627,701 | 12/1986 | Onoda et al. | 250/325 X |
| 4,672,505 | 6/1987 | Tsuchiya et al. | 250/324 X |
| 4,835,568 | 5/1989 | Howard et al. | 355/219 |
| 5,055,879 | 10/1991 | Bhagat | 355/219 |

FOREIGN PATENT DOCUMENTS

| | | |
|---|---|---|
| 0280542 | 8/1988 | European Pat. Off. . |
| 0308185 | 3/1989 | European Pat. Off. . |
| 56-91253 | 7/1981 | Japan . |
| 56-104349 | 8/1981 | Japan . |
| 56-165166 | 12/1981 | Japan . |
| 60-147756 | 8/1985 | Japan . |
| 60-205550 | 10/1985 | Japan . |

*Primary Examiner*—R. L. Moses

*Attorney, Agent, or Firm*—Fitzpatrick, Cella, Harper & Scinto

[57] ABSTRACT

A charging device includes a charging member for electrically charging a member to be charged, a spacer for maintaining a clearance between said charging member and the member to be wherein the clearance is not less than 5 microns and not more than 300 microns. The charging member is supplied with a voltage having a waveform obtained as a sum of an AC voltage and a DC voltage, wherein a peak-to-peak voltage of the vibratory voltage is not less than twice the absolute value of the charge starting voltage relative to the member to be charged.

12 Claims, 3 Drawing Sheets

CHARGING DEVICE

FIELD OF THE INVENTION AND RELATED ART

The present invention relates to a charging device usable with an image forming apparatus such as an electrophotographic machine or an electrostatic recording machine, in which a member to be charged such as a photosensitive member or a dielectric member is uniformly charged or discharged.

As for means for uniformly charging the member to be charged such as the image bearing member to a predetermined potential of a predetermined polarity, a corona discharger such as a corotron or scorotron is widely used since the uniformity of the charging is sufficiently provided.

However, the corona dischargers involve the drawbacks that it requires an expensive high voltage source, that it requires much space therefor and for the shield for the high voltage source or the like, that the production of ozone is relatively large, which requires means against the production and larger size of the device and a higher cost.

Recently, therefore, the consideration is made as to the contact type charging device and apparatus in place of the corona discharger involving the above problems.

In the contact type system, a charging member is contacted to the member to be charged such as the image bearing member, while the charging member is supplied with a voltage which may be a DC voltage of 1–2 Kv or a DC biased AC voltage, by which the member to be charged is charged to a predetermined polarity. It includes a roller charging type (Japanese Laid-open Patent Application No. 91253/1981), blade charging type (Japanese Laid-open Patent Applications Nos. 194349/1981 and 147756/1985), charging and cleaning type (Japanese Laid-open Patent Application No. 165166/1981).

The contact type charging has the advantages that it is possible to lower the voltage of the voltage source, that the production of ozone is very slight, if any, the structure is simple with a small size, that the cost is low, and the like.

Referring to FIG. 6, there is shown an example of an image forming apparatus having such a contact type charging device for uniformly charging the surface of the image forming apparatus. The image forming apparatus comprises an electrophotographic photosensitive member 1, which will hereinafter be called "photosensitive drum", and which is rotated in a direction A indicated by an arrow at a predetermined peripheral speed (process speed).

A charging roller 20 is the charging member, and comprises a conductive core (shaft) 20*a* made of steel or stainless steel or the like, and an outer layer 20*b*, thereon, made of EPDM or the like containing carbon to provide a predetermined low resistance. The charging roller 20 is supported by bearings at the opposite longitudinal ends of the core metal 20*a* for free rotation, and in parallelism with the generating line of the photosensitive drum 1. It is urged to the photosensitive drum 1 with a predetermined pressure so that it rotates following the rotation of the photosensitive drum 1. The apparatus further comprises an external voltage source to the charging roller 20. It supplies a voltage which is a sum of a DC voltage and an AC voltage having a peak-to-peak voltage which is not less than the charge starting voltage between the charging roller 20 and the photosensitive layer. The voltage is supplied to the charging roller 20 through sliding contacts 8 contacted to the ends of the core metal 20*a*.

The surface of the photosensitive drum 1 is sequentially charged by the charging roller 20 which is supplied with such a voltage and which is contacted to the surface to a predetermined potential of a predetermined polarity. The uniformly charged surface of the rotating photosensitive drum 1 thus uniformly charged is exposed to image light 3 bearing the intended image formation (print information) through an unshown exposure means such as analog exposure means for an orginal document, a laser scanner, LED array, liquid crystal shutter array, or the like through a slit or by way of scanning means. By doing so, an electrostatic latent image of the intended information is formed sequentially on the surface of the rotating photosensitive drum 1.

The thus formed electrostatic latent image is developed by a developing device (developing roller) 4 into a toner image, which is in turn transferred onto a transfer material 7 at an image transfer station between the photosensitive drum 1 and a transfer roller 5 supplied with an image transfer bias voltage. The transfer material 7 is fed from unshown feeding mechanism at a predetermined timing in association with the image on the photosensitive drum 1.

The transfer material 7 now having received the toner image is separated from the surface of the photosensitive drum 1, and is introduced into an image fixing apparatus where the toner image is fixed thereon.

The surface of the photosensitive drum after the image transfer is cleaned by a cleaner so that the residual toner or the like is removed therefrom, and the photosensitive drum 1 is prepared for the next image forming operation.

The following drawbacks of the contact type charging device have been found:

1. Production of Tracks of the Charging Device

The outer layer 20*a* of the charging roller 20 is made of EPDM, for example, as described above. The EPDM material is contacted to the surface of the photosensitive drum 1 which is the member to be charged. Plasticizer contained in the EPDM may ooze out thereof and may be transferred to the surface of the photosensitive drum 1 during the period in which the photosensitive drum 1 is not rotated, with the result of tracks of the roller on the photosensitive drum 1. This deteriorates the image quality.

2. Production of Charging Noise

When the AC voltage is applied to the charging roller contacted to the photosensitive drum, the charging roller may vibrate with the result of noise (charging noise).

The problems of the tracks of the charging roller and of the charging noise is common to the blade type rod type or the other, described above.

SUMMARY OF THE INVENTION

Accordingly, it is a principal object of the present invention to provide a charging device which does not involve the problem of the tracks of the charging device with the advantages of the contact type charging device substantially maintained.

It is another object of the present invention to provide a charging device which does not involve the problem of the tracks of the charging device with the advantages of the contact type charging device substantially maintained.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Embodiment 1

Figure 1:
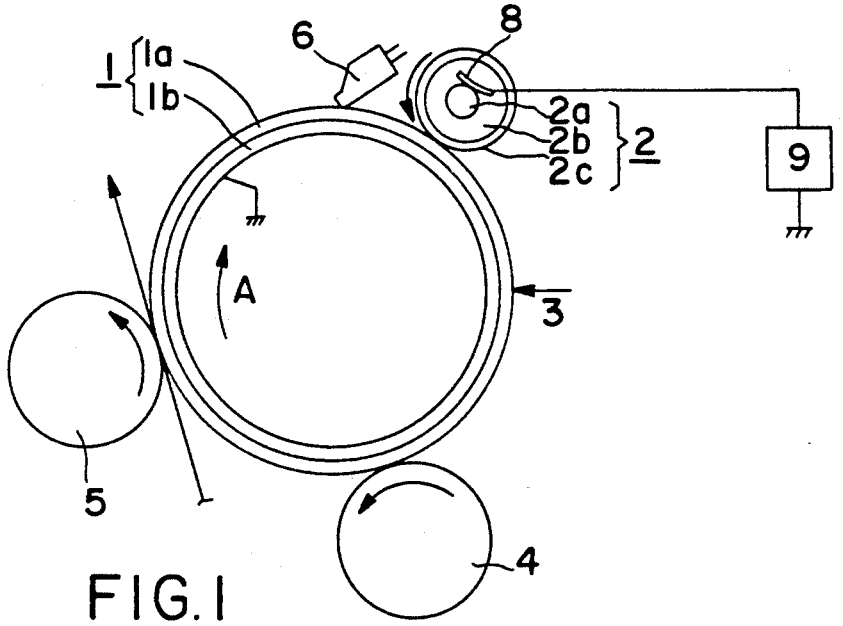
FIG. 1 is a side view of an image forming apparatus according to an embodiment of the present invention.
Figure 2:
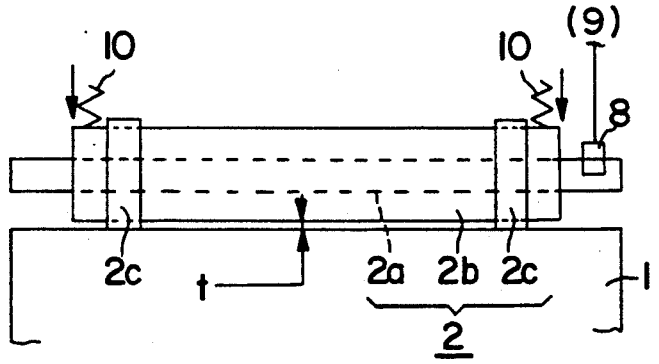
FIG. 2 is a front view of a charging device used in the image forming apparatus of FIG. 1.

Referring to FIG. 1, there is shown an exemplary image forming apparatus using a proximity (non-contact) type charging device for uniformly charging an image bearing member. FIG. 2 is front view of the part adjacent the charging device.

Figure 6:
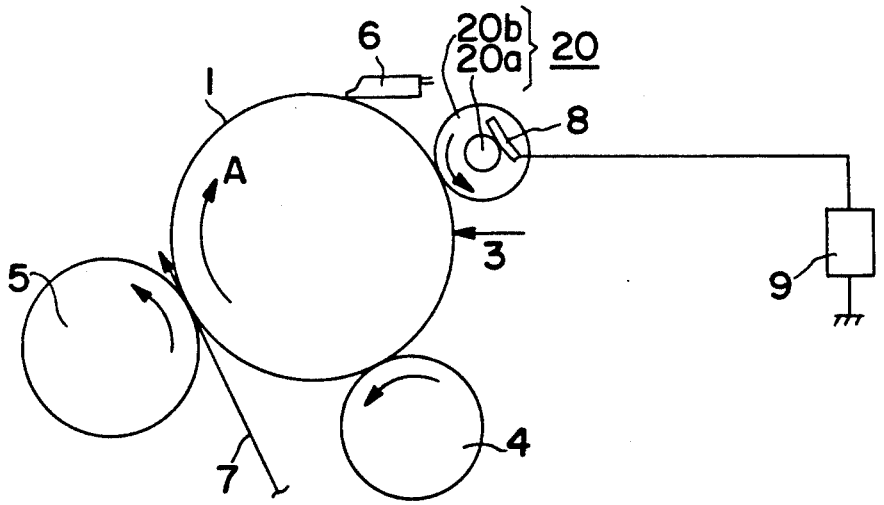
FIG. 6 is a side view of an image forming apparatus using a contact type charging device.

The same reference numerals as in FIG. 6 are assigned to the the elements having the corresponding functions, and the detailed description thereof have been omitted.

The photosensitive drum 1 of this embodiment comprises an aluminum base 1*b* and a photosensitive layer 1*a* on the outer surface of the base 1*b*, which is made of organic photoconductor (OPC). The photosensitive drum 1 has an outer diameter of 30 mm.

The charging roller is designated by a reference numeral 2, it comprises a conductive core (shaft) 2*a* of aluminum, steel or the like, an outer layer 2*b* of EPDM or the like having a resistance lowered by addition of carbon or the like to a predetermined level, and a spacer ring layers 2*c* and 2*c* of nylon, teflon or the like mounted on the outer layer 2*b* along the circumferential periphery thereof at the longitudinal opposite ends.

The charging roller 2 is supported by unshown bearings at the longitudinal opposite ends of the core metal 2*a* to be substantially parallel with the generating line of the photosensitive drum 1. The charging roller 2 is confined by urging means 10 and 10 such as springs adjacent the opposite ends of the charging roller 2, so that the charging roller 2 is pressed to the photosensitive drum 1 at the spacer ring layers 2*c* and 2*c* at a predetermined pressure.

Therefore, the portion of the charging roller 2 between the spacer layers 2*c* and 2*c* is maintained out of contact from the photosensitive drum 1 with a clearance t, corresponding to the thickness of the spacer ring layer 2*c* and 2*c*.

The charging roller 2 may be rotated following the rotation of the photosensitive drum 1 or may be positively driven codirectionally with the photosensitive drum 1, or it may be rotated in the opposite direction, or it may be unrotated.

The charging roller is supplied with an oscillating voltage (the voltage level periodically changes with time) having a waveform provided by biasing an AC voltage with a DC voltage, through sliding contacts 8 contacted to the ends of the core metal 2*a*.

The uniform charging is accomplished by such a voltage setting that a charge starting voltage $V_{TH}$ when only a DC voltage is applied to the charging roller and the peak-to-peak voltage Vpp of the AC voltage component of applied voltage satisfy $vpp \geqq 2|V_{TH}|$.

The charge starting voltage is determined in the following manner. Only DC component is applied to the charging member contacted to the image bearing member (photosensitive member) having a zero surface potential. The voltage of the DC component is gradually increased. The surface potentials of the photosensitive member are plotted with respect to the DC voltage applied thereto with a predetermined increment of the voltage, for example, 100 volts. The first point of the voltage is the one at which the surface potential of the photosensitive member appears, and about ten surface potential are plotted at each 100 volt increment, for example. Using least square approximation, a straight line is drawn from the plots. The DC voltage reading at which the straight line and the line representing the zero surface potential as the charge starting voltage. The waveform may be rectangular, triangular, pulsewise or simple DC form.

The charging operation has been performed with the following conditions:

the clearance t between the central portion of the charging roller 2 and the photosensitive drum 1 by the spacer ring layer 2*c* and 2*c*: 30 microns the peripheral speed of the photosensitive drum 1: $15\pi$ mm/sec the voltages supplied to the charging roller 2 from the voltage source 9: DC of −700 V, and AC of 1500 V and 255 Hz.

It has been confirmed that the surface of the photosensitive drum 1 is charged uniformly to approx. −700 V.

The following table shows the results of the experiments where the clearance t is changed by the spacer ring layer 2*c* and 2*c* from 1 micron to 500 microns.

TABLE 1

| t (microns) | image quality | track of roller | charging noise |
|---|---|---|---|
| 1 | G | N | N |
| 3 | G | S | S |
| 5 | G | G | G |
| 50 | G | G | G |
| 100 | G | G | G |
| 150 | G | G | G |
| 200 | G | G | G |
| 250 | G | G | G |
| 300 | G | G | G |
| 350 | S | G | G |
| 400 | N | G | G |
| 500 | N | G | G |

1) Image Quality

If the clearance is not more than 300 microns the charging is good with the result of good image quality. If the clearance is larger than 350 microns, it exceeds the electric insulation breakdown range, with the result of disability of the normal charging action, and therefore, image quality is degraded. In Table 1, "G" means good image quality; "S" means images with slight defect; and "N" means no good image.

2) Track of Roller

In the range of 1–3 microns of the clearance t, the pits and projections of the charging roller surface are partly in contact with the surface of the photosensitive drum. Therefore, the tracks of the charging roller were observed by the plasticizer contained in the outer layer 2b of the charging roller. If it is larger than 5 microns, the surface of the charging roller is not in contact with the surface of the photosensitive drum, and therefore, the track of the charging roller is not observed. In the Table, "G" means no track of the roller observed; "S" means the tracks appear slightly; and "N" means tracks are observed.

3) Charging Noise

In the range of 1–3 microns of the clearance t, the pits and projections of the charging roller surface are partly in contact with the surface of the photosensitive drum. Therefore, when an external bias is applied to the charging roller, the charging noise is produced. If it is not less than 5 microns, the charging roller is out of contact with the photosensitive drum, and therefore, the charging noise is not produced. In the Table, "G" means no production of the charging noise; "S" means slight production of the charging noise; and "N" means production of the charging noise.

From the experiments and evaluation in the foregoing, it will be understood that the good results can be provided if the clearance between the charging roller and photosensitive drum is 5–300 microns.

In the structure where the charging roller is urged to the photosensitive drum adjacent the opposite ends of the charging roller 2 by urging means 10 and 10, and is contacted to the photosensitive drum at the spacer ring layer 2c and 2c, if the urging force by the urging means is too strong, the charging roller 2 may be warped between the spacer ring layer 2c and 2c in the upward direction, with the result of the larger clearance between the central portion of the charging roller and the photosensitive drum than the clearance defined by the spacer ring layer 2c and 2c. Therefore, even if the thickness of the spacer ring layer 2c and 2c is set to 300 microns, it is possible that the clearance between the central portion of the charging roller and the photosensitive drum is larger than the tolerable 300 microns due the warping of the charging roller.

Figure 3A:
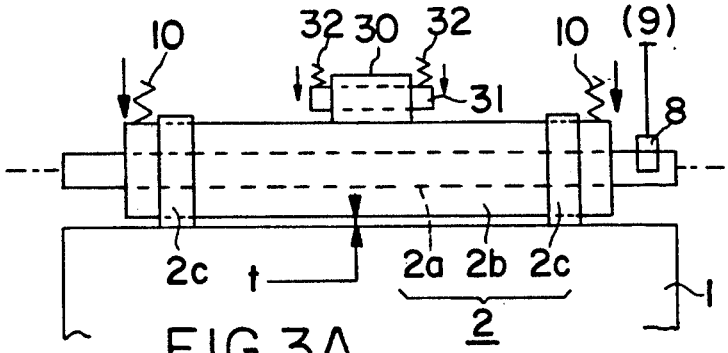
FIGS. 3A, 3B and 3C are sectional views of charging devices according to other embodiments of the present invention having different roller warp preventing means.
Figure 3B:
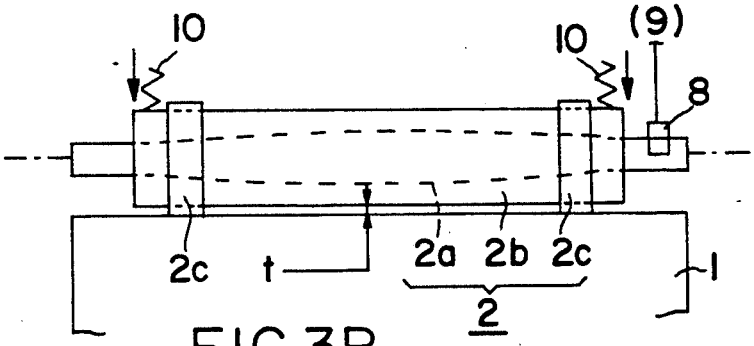
Figure 3C:
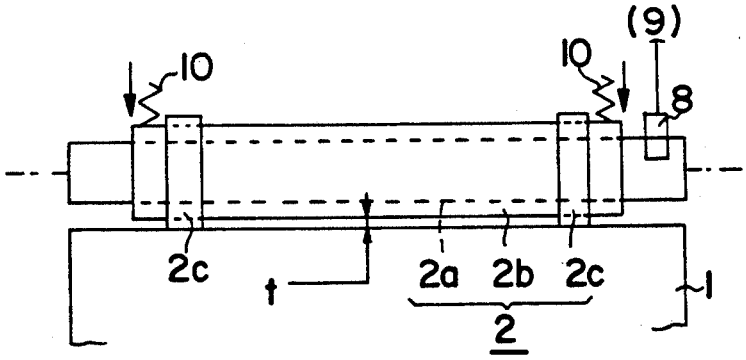

FIGS. 3A, 3B and 3C show the measures against this. In FIGS. 3A, a confining roller 30 is disposed in the middle of the charging roller 2 to prevent the warping, the roller 30 is supported on the shaft 31, and the roller 32 is urged by a spring 32 to the charging roller 2. Even if the charging roller 2 tends to warp upwardly due to too strong forces by the urging means 10 and 10 with the result of the tendency of warping of the charging roller in the middle region. However, the tendency is suppressed so that the clearance t is between the charging roller 2 and the photosensitive drum 1 is maintained at the level corresponding to the thickness of the spacer ring layer 2c and 2c.

FIG. 3B shows an example in which the core metal 2a of the charging roller 2 has a diameter which is larger at the central portion than at the longitudinal end portions to suppress the warping of the charging roller 2 at the middle portion.

In the example of FIG. 3C, the diameter of the core metal 2a is uniformly increased to such an extent that the warping of the charging roller does not occur. The material cost increases corresponding to the increase of the diameter. However, the core metal is a straight roller, it is easy to polish. Totally, this example is low in cost.

Embodiment 2

Figure 4:
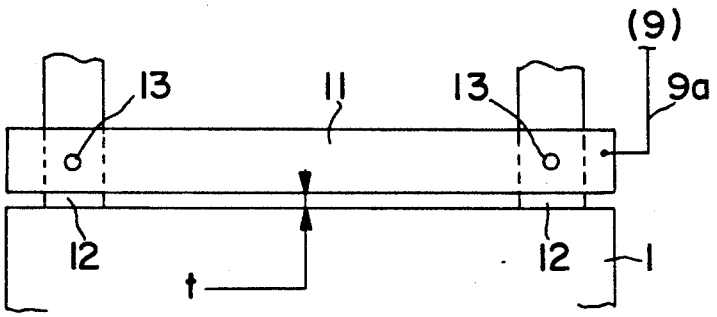
FIG. 4 is a front view according to a further embodiment of the present invention using a charging blade.
Figure 5:
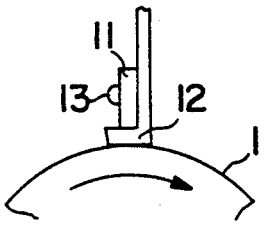
FIG. 5 is a side view thereof.

Referring to FIGS. 4 and 5, there is shown an embodiment wherein the charging member is in the form of a blade. A charging blade 11 is made of conductive material. The longitudinal end portions of the charging blade are mounted on spacer members 12 and 12 by screws 13 and 13. The spacer members 12 and 12 are supported on a stationary member not shown. The clearance t between the charging blade 11 and the photosensitive drum 1 is defined by the spacer members 12 and 12. The voltage is supplied to the charging blade 11 from the voltage source directly through a lead wires 9a.

In this example, as will be understood, the charging member 11 is not movable, so that the electric noise due to the electric contacts can be suppressed. In addition, the required space is smaller than in the charging roller. Because the necessity for the confining of the charging member by the urging means as in the case of the charging roller, can be eliminated. Therefore, the problem of the warping is avoided.

As described in the foregoing, according to the present invention, the proximity type charging device of the present invention substantially maintains the advantages of the contact type charging roller, and additionally advantageous in that tracks of the charging device and the charging noise as produced in the contact type charging device can be avoided.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a charging member for electrically charging a member to be charged;

means for maintaining a clearance of not less than 5 microns and not more than 300 microns between said charging member and the member to be charged; and voltage application means for applying a vibratory voltage between the charging member and the member to be charged.

2. A device according to claim 1, wherein said charging member is stationary in use.

3. A charging device according to claim 1, where a peak-to-peak voltage of the vibratory voltage is not less than twice the absolute value of the charge starting voltage relative to the member to be charged.

4. A device according to claim 1, wherein said charging member is in the form of a rotatable roller.

5. A devcie according to claim 1, wherein said charging member is in the form of a blade.

6. A device according to claim 4, wherein said charging member rotates following movement of the member.

7. A device according to claim 3, wherein said charging member is in the form of a rotatable roller.

8. A device according to calim 3, wherein said charging member is in the form of a blade.

9. A device according to claim 7, wherein said charging member rotates following movement of the member.

10. A device according to claim 1, wherein the clearance is about 30 microns.

11. An image forming apparatus, comprising:

an image bearing member;

means for forming an image on said image bearing member;

a charging member for electrically charging the image bearing member;

means for maintaining a clearance of not less than 5 microns and not more than 300 microns between said charging member said image bearing member; and voltage application means for applying a vibratory voltage between said charging member and said image bearing member.

12. An image forming apparatus according to claim 11, wherein the clearance is about 30 microns.

* * * * *